United States Patent [19]

Hone et al.

[11] 4,412,873

[45] Nov. 1, 1983

[54] SINTERED METAL ARTICLES AND THEIR MANUFACTURE

[75] Inventors: John W. Hone; Terence M. Cadle, both of Coventry, England

[73] Assignee: Brico Engineering Limited, Coventry, England

[21] Appl. No.: 320,428

[22] Filed: Nov. 12, 1981

[30] Foreign Application Priority Data

Nov. 19, 1980 [GB] United Kingdom ..... 8037172

[51] Int. Cl.[3] ..... C21D 1/48

[52] U.S. Cl. ..... 148/16.5; 148/16.6; 419/27; 427/383.9; 427/437

[58] Field of Search ..... 148/16.6, 16.5, 16.7; 75/200, 208 R, 246; 427/227, 437, 438, 383.7, 383.9; 419/27

[56] References Cited

U.S. PATENT DOCUMENTS

| | | | |
|---|---|---|---|
| 2,409,295 | 10/1946 | Marvin et al. | 427/247 |
| 2,456,779 | 12/1948 | Goetzel | 427/383.9 |
| 2,489,839 | 11/1949 | Whitney | 148/16.5 |
| 2,653,377 | 9/1953 | Seelig | 148/16.5 |
| 4,261,745 | 4/1981 | Watanabe et al. | 75/208 R |

FOREIGN PATENT DOCUMENTS

| | | |
|---|---|---|
| 51-37008 | 3/1976 | Japan . |
| 544153 | 3/1942 | United Kingdom . |
| 644907 | 10/1950 | United Kingdom . |
| 659073 | 10/1951 | United Kingdom . |
| 1399812 | 7/1975 | United Kingdom . |
| 1488762 | 10/1977 | United Kingdom . |

OTHER PUBLICATIONS

A Dictionary of Metallurgy, A. D. Merriam, 1958, p. 249.

Treatise on Powder Metallurgy—Goetzer—vol. II, pp. 533; 535.

*Primary Examiner*—John P. Sheehan

*Attorney, Agent, or Firm*—Leydig, Voit, Osann, Mayer & Holt, Ltd.

[57] ABSTRACT

Sintered metal articles especially sealing rings of less than 25 mm diameter are formed by plating sintered metal skeletons with a metal of lower melting point than the metal of the skeletons, for example, copper. The plated skeletons are then heated, preferably in a stack, to melt the plated metal, which infiltrates the skeletons. The articles so produced are stronger than and have greater elasticity than the skeletons themselves due to the presence of the plated metal in the skeletons.

14 Claims, No Drawings

SINTERED METAL ARTICLES AND THEIR MANUFACTURE

BACKGROUND TO THE INVENTION

1. Field of the Invention

The invention relates to the manufacture of sintered metal articles particularly, but not exclusively, sealing rings in the range from 12 mm to 25 mm diameter, for use either as shaft seals or as sealing rings in reciprocating piston and cylinder devices such as shock absorbers.

Articles produced by sintering metal powders generally contain internal pores. These pores are disadvantageous in that they reduce the strength and modulus of elasticity of the article in comparison with similar articles produced, for example, by casting and forging.

2. Description of the Prior Art

Two known proposals for overcoming these disadvantages have been to spray copper onto the surface of the article or to place copper powder or a piece of copper or copper alloy of appropriate shape on the surface of the article and then heat the copper or copper alloy and the article to a temperature above the melting point of the copper or copper alloy so that the copper or copper alloy infiltrates the pores. It is desirable that the weight of copper applied to the article be carefully controlled so that there is sufficient copper to fill the pores but not an excess of copper.

It is a disadvantage of such previous proposals that, in the case of articles of small size and weight where very small quantities of copper or copper alloy are required, the quantity of copper or copper alloy associated with the sintered article cannot be closely controlled, due to the way in which the copper or copper alloy is applied.

SUMMARY OF THE INVENTION

According to a first aspect of the invention, there is provided a method of manufacturing sintered metal articles comprising the steps of taking a sintered metal skeleton, selecting a metal which has a lower melting point than the metal of the skeleton and which, when melted, will infiltrate the skeleton, plating the lower melting point metal onto at least a part of the sintered metal skeleton, and then heating the plated skeleton to a temperature greater than the melting point of the plated metal whereby the plated metal is caused to infiltrate the sintered metal skeleton.

It is a further disadvantage of the aforementioned previous proposals that, if the copper or copper alloy-bearing surfaces of two or more articles are in direct contact with one another before heating, the articles stick together on heating and are consequently scrap. To prevent this, it has previously been proposed to heat the articles separately or to use a parting agent between the adjacent surfaces to ensure that sticking does not occur. These measures are both expensive and time consuming.

According to a preferred aspect of the invention, the heating step may comprise heating a plurality of said skeletons arranged in a stack with their plated surfaces in direct contact to reduce the space occupied by said articles during heating, the articles being readily separated after the heating step.

According to a second aspect of the invention, there is provided a sintered metal article when made by the method of the first aspect of the invention.

DESCRIPTION OF THE PREFERRED EMBODIMENTS

An example of a method of manufacturing sintered metal articles according to the invention and of articles produced by such a method will now be described.

A sintered iron-alloy skeleton is first prepared by, for example, the process described between lines 47 and 76 on page 1 of our British Pat. No. 1,399,812. This process comprises selecting a pre-alloy or partial pre-alloy metal powder of a particular composition, mixing the powder with carbon and, optionally, a lubricant, compacting the mixture and then sintering the compacted mixture to form a sintered skeleton.

The skeleton may be prepared by the process described in any one of British Pat. Nos. 1,102,662; 1,399,812; 1,461,273; 1,576,143; 1,580,686; 1,580,687; 1,580,688 and 1,580,689.

The skeleton may also be prepared by the method described in our co-pending British patent application No. 8,037,173 which comprises the steps of selecting a powder having, by weight, the composition, 0.1–0.9% carbon, 8–18% chromium, and optionally, 0–1% manganese, 0–1% molybdenum, 0–1% silicon, 0–1% phosphorus, 0–0.1% sulphur, 0–2.5% nickel, balance iron; mixing the powder with 1% to 10%, by weight of the powder, of a lubricant in powder form which remains solid at the sintering temperature of the mixture, compacting the mixture to a required shape, sintering the compacted mixture at or above 1200° C. and cooling to produce an alloy having the lubricant contained within the matrix.

The sintered skeleton may be in the shape of a sealing ring in the range from 12 mm to 25 mm diameter, for use either as shaft seals or as sealing rings in reciprocating piston and cylinder devices such as shock absorbers.

The sintered skeleton is then lowered into an electroplating bath and is connected as a cathode in an electrical circuit with a copper anode with a copper sulphate solution as an electrolyte. Current is then passed for a time sufficient to plate the skeletons with an amount of copper which is between 8% and 25% and is preferably between 10% and 15% of the weight of the skeleton. The copper plated skeletons are then removed from the electroplating bath and are washed with water to remove surplus electrolyte. The conditions for achieving such a quantity can be readily calculated by known methods.

Alternatively, an electroless plating method of any known or convenient kind may be used.

Plating techniques allow a required amount of copper to be applied to a skeleton even where the skeleton is very small, for example, where the weight of the skeleton is 1 gramme and the amount of copper required is, for example, 0.1 gramme. Thus a very small skeleton can readily be coated with copper by plating techniques and a large number of such skeletons can be accurately plated rapidly either in batches or in a continuous process.

Next, the copper-plated skeletons, e.g. for use as sealing rings, are stacked with their plated surfaces in direct contact and are heated to a temperature above the melting point of the copper but below the solidus of the iron alloy. The temperature may be the sintering temperature of the metal of the skeleton. The stacking of the skeletons saves space during heating, thus allowing a large number of skeletons to be heated together. The copper melts and infiltrates at least those pores which are adjacent the surface of the skeletons. After cooling, the copper-infiltrated skeletons are separated from the stacks.

It has been found that the separation of the skeletons after heating can be achieved easily since the heating does not cause adjacent skeletons to stick together, even though the copper on the surfaces of adjacent skeletons is in direct contact without any intervening parting agent. It is believed at the present time that this is due to the absence, in the copper plated onto the skeletons, of traces of silicon or magnesium or other elements which, on heating, form oxides which cause adjacent skeletons to stick together, thereby rendering the articles useless.

The presence of the copper in the pores of the skeleton increases both the ultimate tensile strength of the finished article and the modulus of elasticity.

The ultimate tensile strength of the finished articles can be further increased in the case of suitable ferrous alloys by case-hardening the articles by heating the articles in a carbonaceous atmosphere to produce a high-carbon surface zone or by carbo-nitriding.

It will be appreciated that the skeletons may be made from materials which are not iron alloys or may be iron alloys having compositions other than those exemplified above. In addition, the metal plated onto the skeletons need not be copper but may be any other suitable material, for example lead which, when melted, has the ability to 'wet' the skeleton and will thus infiltrate the skeleton.

We claim:

1. A method of manufacturing sintered metal articles infiltrated with a selected metal comprising the steps of:

taking a sintered metal skeleton, selecting a metal which has a lower melting point than the metal of the skeleton and which, when melted, will infiltrate the skeleton, electro-plating the lower melting point metal onto at least a part of the sintered metal skeleton, and then heating the plated skeleton to a temperature greater than the melting point of the plated metal whereby the plated metal is caused to infiltrate the sintered metal skeleton, whereby to produce a sintered metal article in which the skeleton is infiltrated by the selected metal to increase the strength of the article.

2. A method according to claim 1 wherein said plating step comprises plating the whole of the surface of the metal skeleton with said plating metal.

3. A method according to claim 1 wherein said plating step comprises plating onto the surface of the metal skeleton an amount of the plating metal which, by weight, is from 8% to 25% of the weight of the metal skeleton.

4. A method according to claim 1 wherein said plating step comprises plating onto the surface of the metal skeleton an amount of the plating metal which, by weight, is from 10% to 15% of the weight of the skeleton.

5. A method according to claim 1 wherein the metal of the skeleton is an iron alloy and wherein the plated metal is copper or a copper-base alloy.

6. A method according to claim 1 wherein the heating step comprises heating a plurality of plated skeletons arranged in a stack with their plated surfaces in direct contact.

7. A method according to claim 1 and comprising the further step of case hardening the metal infiltrated sintered metal skeleton after the heating step.

8. A method of manufacturing sintered metal articles infiltrated with a selected metal comprising the steps of:

taking a sintered metal skeleton, selecting a metal which has a lower melting point than the metal of the skeleton and which, when melted, will infiltrate the skeleton, electroless plating the lower melting point metal onto at least a part of the sintered metal skeleton, and then heating the plated skeleton to a temperature greater than the melting point of the plated metal whereby the plated metal is caused to infiltrate the sintered metal skeleton, whereby to produce a sintered metal article in which the skeleton is infiltrated by the selected metal to increase the strength of the article.

9. A method according to claim 8 wherein said plating step comprises plating the whole of the surface of the metal skeleton with said plating metal.

10. A method according to claim 8 wherein said plating step comprises plating onto the surface of the metal skeleton an amount of the plating metal which, by weight, is from 8% to 25% of the weight of the metal skeleton.

11. A method according to claim 8 wherein said plating step comprises plating onto the surface of the metal skeleton an amount of the plating metal which, by weight, is from 10% to 15% of the weight of the skeleton.

12. A method according to claim 8 wherein the metal of the skeleton is an iron alloy and wherein the plated metal is copper or a copper-base alloy.

13. A method according to claim 8 wherein the heating step comprises heating a plurality of plated skeletons arranged in a stack with their plated surfaces in direct contact.

14. A method according to claim 8 and comprising the further step of case hardening the metal infiltrated sintered metal skeleton after the heating step.

* * * * *